US007631789B2

(12) United States Patent
Dodd et al.

(10) Patent No.: US 7,631,789 B2
(45) Date of Patent: Dec. 15, 2009

(54) TRIGGER SPRAYER HAVING SECURE DELIVERY TUBE CONNECTION

(75) Inventors: Joseph K. Dodd, Lee's Summit, MO (US); Linn D. Wanbaugh, Blue Springs, MO (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 531 days.

(21) Appl. No.: 11/072,161

(22) Filed: Mar. 4, 2005

(65) Prior Publication Data

US 2005/0194408 A1 Sep. 8, 2005

Related U.S. Application Data

(60) Provisional application No. 60/549,902, filed on Mar. 5, 2004.

(51) Int. Cl.
*B67D 5/60* (2006.01)

(52) U.S. Cl. ..... 222/464.4; 222/382; 222/383.1; 222/464.1; 222/527; 222/530

(58) Field of Classification Search ..... 222/464.4, 222/464.1, 464.3, 383.1, 382, 527, 530, 383.3; 239/333

See application file for complete search history.

(56) References Cited

U.S. PATENT DOCUMENTS 4,832,237 A 5/1989 Hurford, Jr.
5,469,993 A 11/1995 Hauf et al.
5,553,750 A 9/1996 Foster
5,611,467 A * 3/1997 Peng ..... 222/464.4
5,839,620 A 11/1998 Battegazzore
5,860,574 A 1/1999 Shanklin et al.
6,050,459 A 4/2000 Johnson et al.
6,170,706 B1 1/2001 Havlovitz
6,409,052 B1 6/2002 Barriac et al.
6,467,657 B2 * 10/2002 Shanklin et al. ..... 222/511
6,779,693 B2 8/2004 Sweeton et al.
6,820,769 B2 * 11/2004 Foster et al. ..... 222/153.13
6,833,072 B1 * 12/2004 Krestine et al. ..... 210/416.1
6,935,542 B2 * 8/2005 Harrity et al. ..... 222/382

FOREIGN PATENT DOCUMENTS

WO WO 88/06693 9/1988

* cited by examiner

*Primary Examiner*—Frederick C. Nicolas

(57) ABSTRACT

In one embodiment of a dispensing system for connecting a remote power sprayer to a container of liquid, a flexible delivery tube includes one end non-removably connected to a remote retainer and the other end non-removably connected to a connector hose. The remote retainer and connector hose each include strain relief elements which respectively include a retainer adaptor and a connector adaptor for relieving the connection strain between the tube, the remote retainer and connector hose, as the power sprayer is being pulled and maneuvered during use. In a second embodiment, the flexible delivery tube includes one end non-removably connected to a remote retainer and the other end disposed freely in a container, but plugged onto a connector hose and including a spring weight slidably disposed thereon.

17 Claims, 5 Drawing Sheets

58
30
26
22
18
24
16
12
28
15
46
54
14
36
31
49
20
33
41
48
35
50
39
32
52
43
44
10b

TRIGGER SPRAYER HAVING SECURE DELIVERY TUBE CONNECTION

This application claims priority from provisional application Ser. No. 60/549,902 filed Mar. 5, 2004.

BACKGROUND OF INVENTION a. Field of Invention

The invention relates generally to a trigger actuated dispensing system and, more particularly, to a dispensing assembly for connecting a remote trigger sprayer to a container of liquid to be dispensed.

b. Description of Related Art

Remote dispensing systems for spraying of especially pesticides, insecticides, plant and grass nutrients, and the like, for lawn and garden applications, have been available in many forms for a number of years. One such system disclosed in U.S. Pat. No. 5,553,750, the disclosure of which is incorporated herein by reference, includes a trigger sprayer having a cylindrical handle connected to a container closure and having a flexible tube stored in accordance with one embodiment within the container during periods of non-use and capable of being drawn from the container during a spraying operation. In another embodiment, the flexible tube is coiled and stored within a receptacle located within the container during periods of the non-use. During the spraying operation, the trigger sprayer is removed from the closure and the tube is uncoiled from its receptacle.

During the spraying operation, the tube can be pulled and may thereby become disconnected from the container and/or the trigger sprayer. One method of preventing such disconnection is to insert the tube within multiple fittings within the trigger sprayer and/or the container closure. Although the use of multiple fittings provides adequate retention for initial usage, repeated pulling over a period of time and changes in the tube structural conditions due to interaction with product tend to deteriorate the seal between the tube and fittings, thus leaving the tube susceptible to complete disconnect from the sprayer and/or container.

U.S. Pat. No. 6,050,459, the disclosure of which is incorporated herein by reference, discloses a rigid dip tube connector for a liquid spray dispenser which includes a cap body having a shipper cap hinged over its upper end and a connector attached to the flexible tube to effect connection of a trigger sprayer to the container. The coupler between the connector and the closure is however so structured that it presents a relatively insecure coupling, and is susceptible to disconnection from the container when pulled.

There is therefore a need to improve upon such a connector which would be of simpler and less costly design yet highly effective in coupling a flexible tube to a rigid dip tube or in coupling a flexible tube and dip tube assembly to a container.

Yet further, U.S. Pat. No. 6,409,052, commonly owned herewith and the disclosure of which is incorporated herein by reference, discloses a trigger sprayer dispensing system for remote operation and includes a flexible delivery tube which may be coiled and stored within a hollow gripper handle provided on the trigger sprayer. A one-piece adaptor is non-removably connected to a distal end of the delivery tube and connects to the container by mounting directly to an external dip tube of the container or by mounting in a closure cap of the container.

With regard to U.S. Pat. No. 6,409,052, there is yet a further need to improve upon the aforementioned sprayer mounting and tube storage techniques disclosed which would be of simpler and less costly design yet highly effective in coupling a flexible tube to a rigid dip tube or in coupling a flexible tube and dip tube assembly to a container.

SUMMARY OF INVENTION

It is therefore an object of the present invention to provide an improved trigger sprayer dispensing system for securely connecting the trigger sprayer to a container of liquid in a manner rendering it easier to mass produce, store and ship, and convenient to carry, use and re-store for later usage.

In one embodiment of the dispensing system, a flexible delivery tube includes one end thereof non-removably connected to a remote retainer and the other end thereof non-removably connected to a connector hose. The remote retainer and connector hose each include strain relief means which respectively include a retainer adaptor and a connector adaptor for relieving the connection strain between the tube, the remote retainer and connector hose, as the power sprayer is being pulled and maneuvered during use. In a second embodiment, the flexible delivery tube includes one end thereof non-removably connected to a remote retainer and the other end disposed freely in a container, but plugged onto a connector hose and including a spring weight slidably disposed thereon.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1:
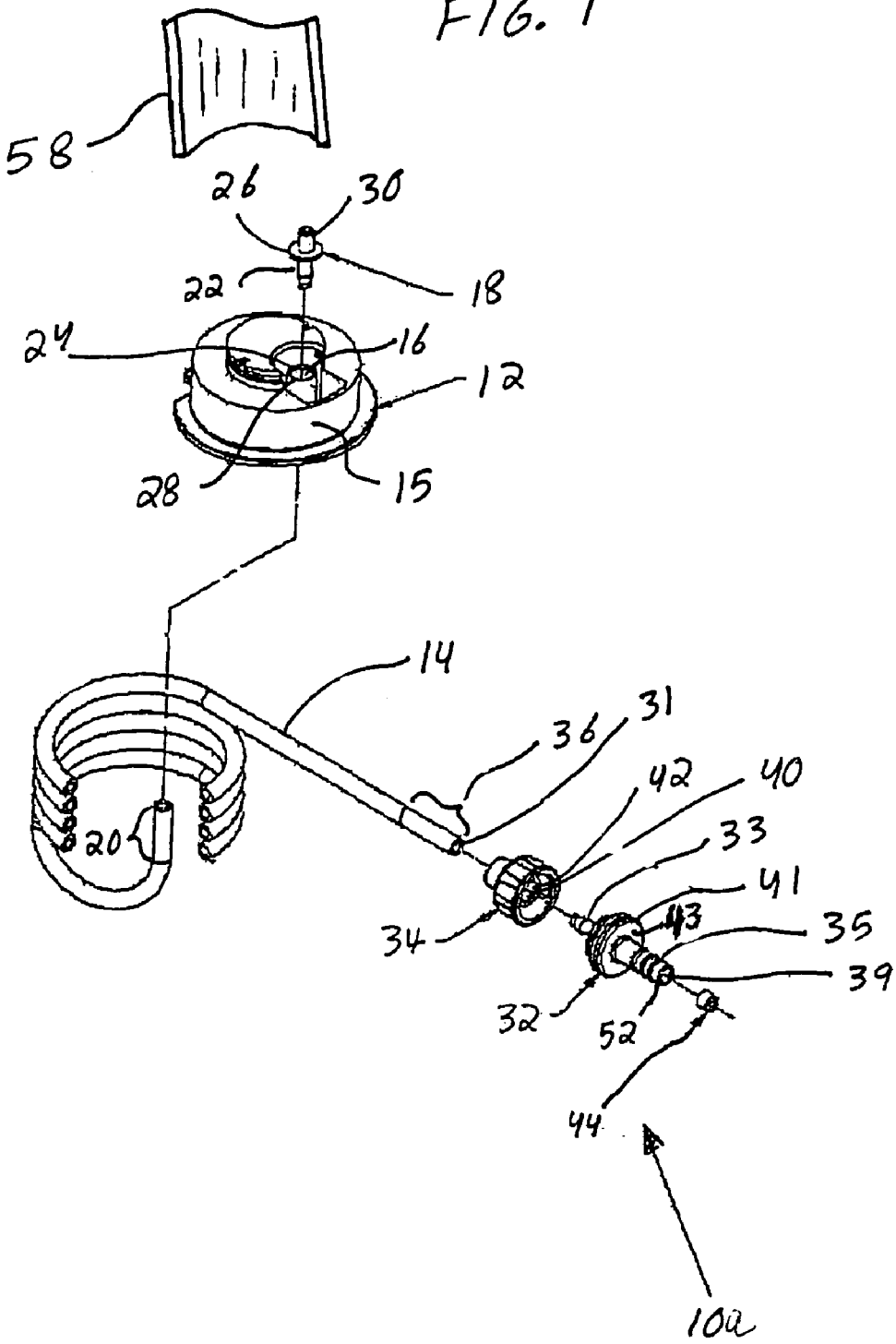
FIG. 1 is an exploded view of a first embodiment of the dispensing system according to the present invention, illustrating the remote retainer mounting location relative to the flexible delivery tube disclosed in its coiled storage/shipping configuration, and a cutout section of a power sprayer handle.

Referring now to the drawings wherein like reference numerals designate corresponding parts throughout the several views, FIGS. 1-9 illustrate two embodiments of a dispensing system according to the present invention, generally designated 10*a* and 10*b*.

Figure 3:
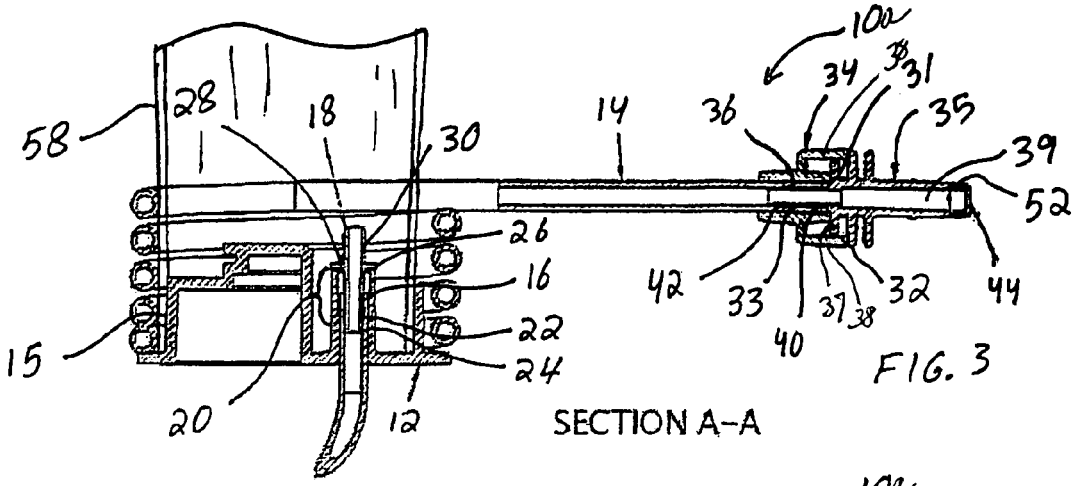
FIG. 3 is a cross-sectional view of the dispensing system of FIG. 1, taken generally along line A-A in FIG. 2, illustrating the internal features of the dispensing system, and a cutout section of a power sprayer handle.
Figure 2:
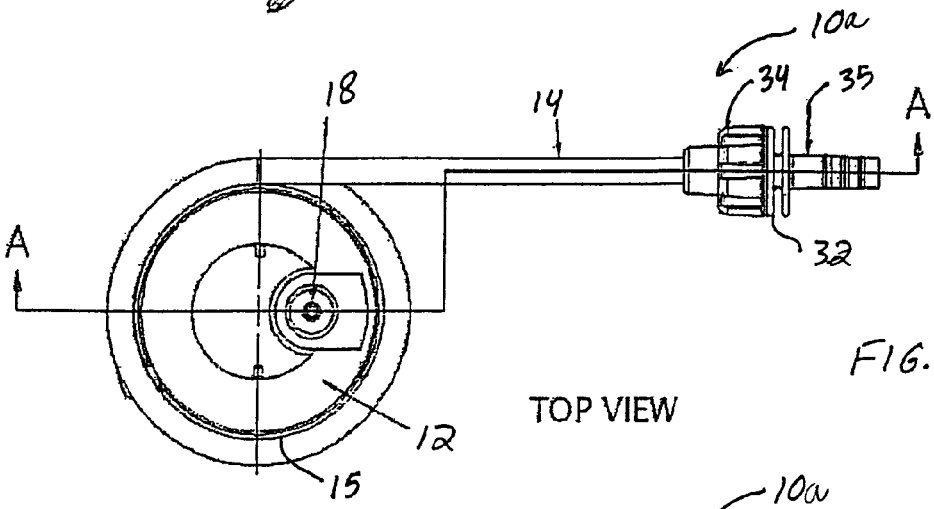
FIG. 2 is a top view of the first embodiment of the dispensing system of FIG. 1, illustrating the dispensing system in an assembled configuration and the flexible delivery tube disclosed in its coiled storage/shipping configuration.
Figure 4:
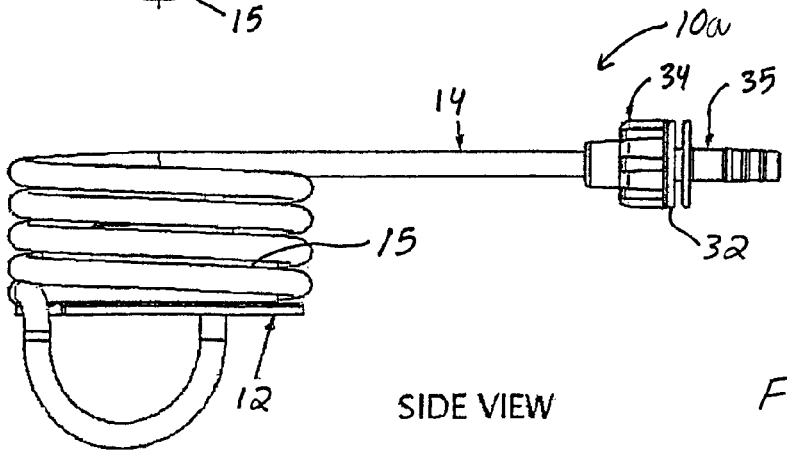
FIG. 4 is a side view of the dispensing system of FIG. 1, illustrating the dispensing system in an assembled configuration and the flexible delivery tube disclosed in its coiled storage/shipping configuration.
Figure 9:
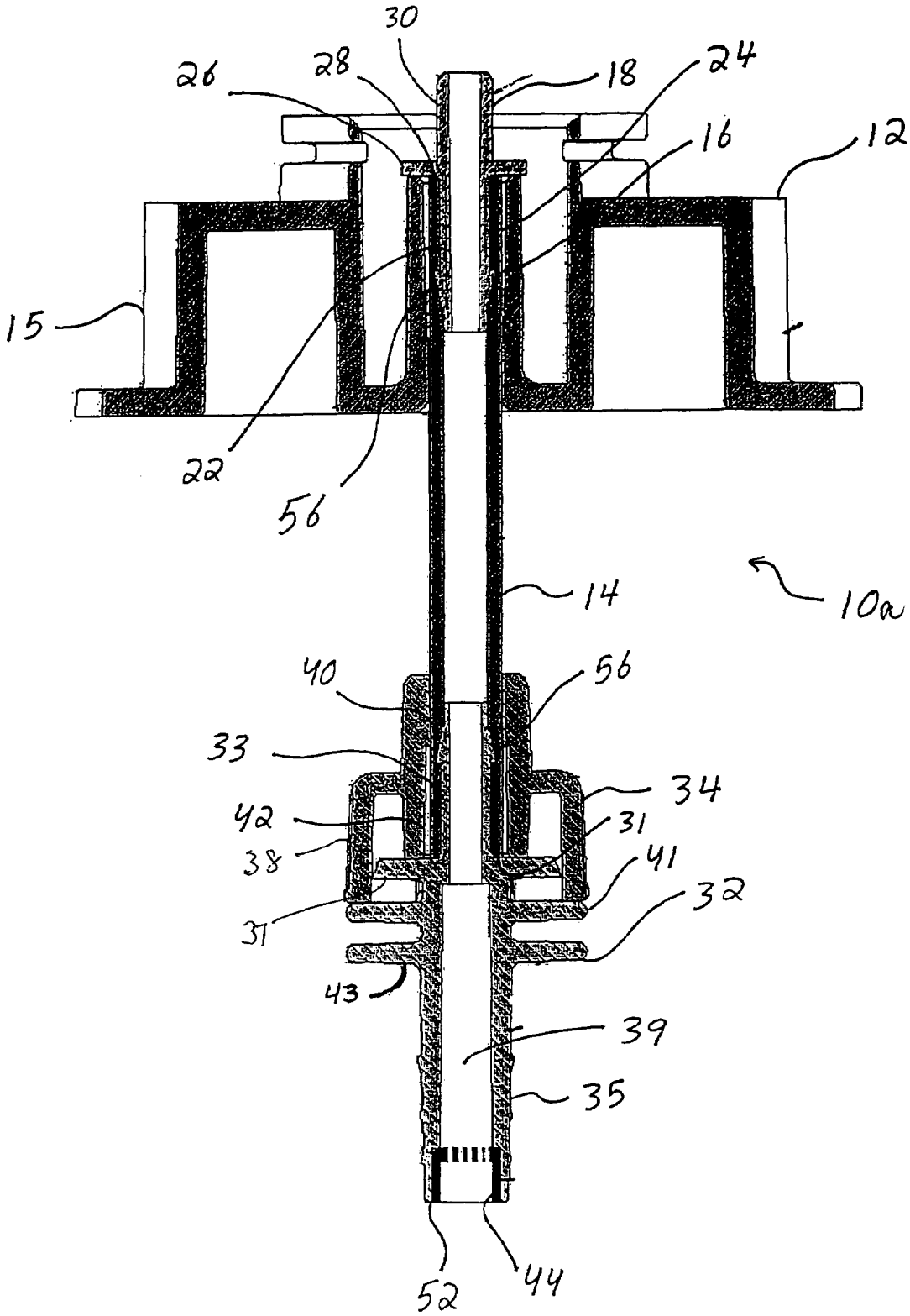
FIG. 9 is an enlarged view illustrative of the strain relief means for connecting the flexible delivery tube to a remote retainer and a connector hose according to the first and second embodiments of the dispensing system of FIGS. 1 and 5.

As shown in FIGS. 1-4 and 9, the first embodiment 10*a* of the dispensing system of the invention may generally include a trigger sprayer, such as a power sprayer 58 of known design removably mounted onto remote retainer 12 for spraying liquid product from a container (not shown) therethrough. The container may include a liquid to be dispensed such as for lawn or garden treatment, and may be of a high density polypropylene. Dispensing system 10 may include flexible delivery tube 14 inserted into elongated opening 16 of remote retainer 12 and plugged onto one end of retainer adaptor 18 until it reaches retention ring 26 of retainer adaptor 18. As shown in FIGS. 1, 3 and 9, tube 14 may be sealingly retained within elongated opening 16 such that the internal wall of section 20 is sealingly disposed onto tube retention nipple 22 of adaptor 18, and the external wall of section 20 is sealingly compressed by internal wall 24 of elongated opening 16. In this manner, with section 20 of tube 14 clamped between elongated opening 16 and tube retention nipple 22 of adaptor 18, retainer adaptor 18 functions to relieve the connection strain between remote retainer 12 and tube 14 as power sprayer 58 is maneuvered during use, which tends to disconnect tube 14 from remote retainer 12. Tube retention nipples 22 and 33 (described below) of retainer adaptor 18 and connector hose 32 (described below), respectively, may each include circular ridges 56 which dig into tube 14 to prevent tube 14 from being removed therefrom.

In the embodiment of FIGS. 1-4 and 9, retention ring 26 of retainer adaptor 18 may be disposed in contiguous engagement with upper rim 28 of elongated opening 16 to prevent adaptor 18 from being inserted through opening 16. The opposite nipple 30 of adaptor 18 may include a product inlet tube (not shown) connected to a product housing (not shown) within power sprayer 58 for supplying product from tube 14 out through the power sprayer, as discussed in greater detail in co-owned U.S. Ser. No. 10/791,285, entitled "Discharge/Vent Module for Power Sprayer," filed Mar. 3, 2004, and hereby incorporated by referenced herein in its entirety.

As illustrated in FIGS. 1-4 and 9, flexible delivery tube 14 may be coiled during storage and shipping around ring 15 of remote retainer 12, and may extend longitudinally upon uncoiling thereof for discharging product therethrough. Additionally, during storage and shipping, tube 14 and the remaining components of dispensing system 10 may be generally retained in the coiled configuration illustrated in FIG. 1 by means of shrink-wrap, clamps and the like.

The opposite distal end 31 of tube 14 may be non-removably plugged onto connector hose 32, which may be connected to a prefabricated cylindrical hole within a closure (not shown) of a container, as discussed in detail in U.S. Pat. No. 6,409,052. Tube 14 may be retained on connector hose 32 by means of connector adaptor 34. Connector hose 32 according to the present invention may be of one-piece plastic construction having a cylindrical body with a tube retention nipple 33 and an opposite nipple 35 depending therefrom. The body of connector hose 32 may include a plurality of radially extending rings 37, 41, 43, and the longitudinally extending nipples 33 and 35 with a central passage 39 being coaxial with each nipple. As shown in FIGS. 1, 3 and 9, section 36 of tube 14 may be plugged onto tube retention nipple 33 of connector hose 32 such that the internal wall of section 36 is sealingly disposed onto tube retention nipple 33, and the external wall of section 36 is sealingly compressed by internal wall 40 of elongated opening 42 provided in connector adaptor 34. In this manner, with section 36 of tube 14 clamped between elongated opening 42 and tube retention nipple 33, connector adaptor 34 functions to relieve the connection strain between connector hose 32 and tube 14 as the hose assembly including connector hose 32, connector adaptor 34 and filter 44 is connected to a container. Also, as best shown in FIGS. 3 and 9, the connector adaptor 34 is provided with an outer wall 38 having an inner surface that extends over and frictionally engages the outer edge of ring 37 of the connector hose 32. Ring 41 of the connector hose 32 can act as a seating surface for the outer wall 38.

As briefly discussed above, and as discussed in detail in U.S. Pat. No. 6,409,052, tube retention nipple 33 of connector hose 32 may be snap fitted into a prefabricated cylindrical hole in the container closure for enabling the passage of liquid product from a rigid dip tube (not shown) which extends as in any normal manner into the container toward the container bottom wall to form an inlet passage for the liquid from the container to the pump chamber of power sprayer 58, via connector hose 32, through tube 14, retainer adaptor 18, into product inlet tube and out through the power sprayer.

The second embodiment 10*b* of dispensing system of the invention will now be described in detail with reference to FIGS. 5-8 and also with partial reference to FIG. 9.

Figure 5:
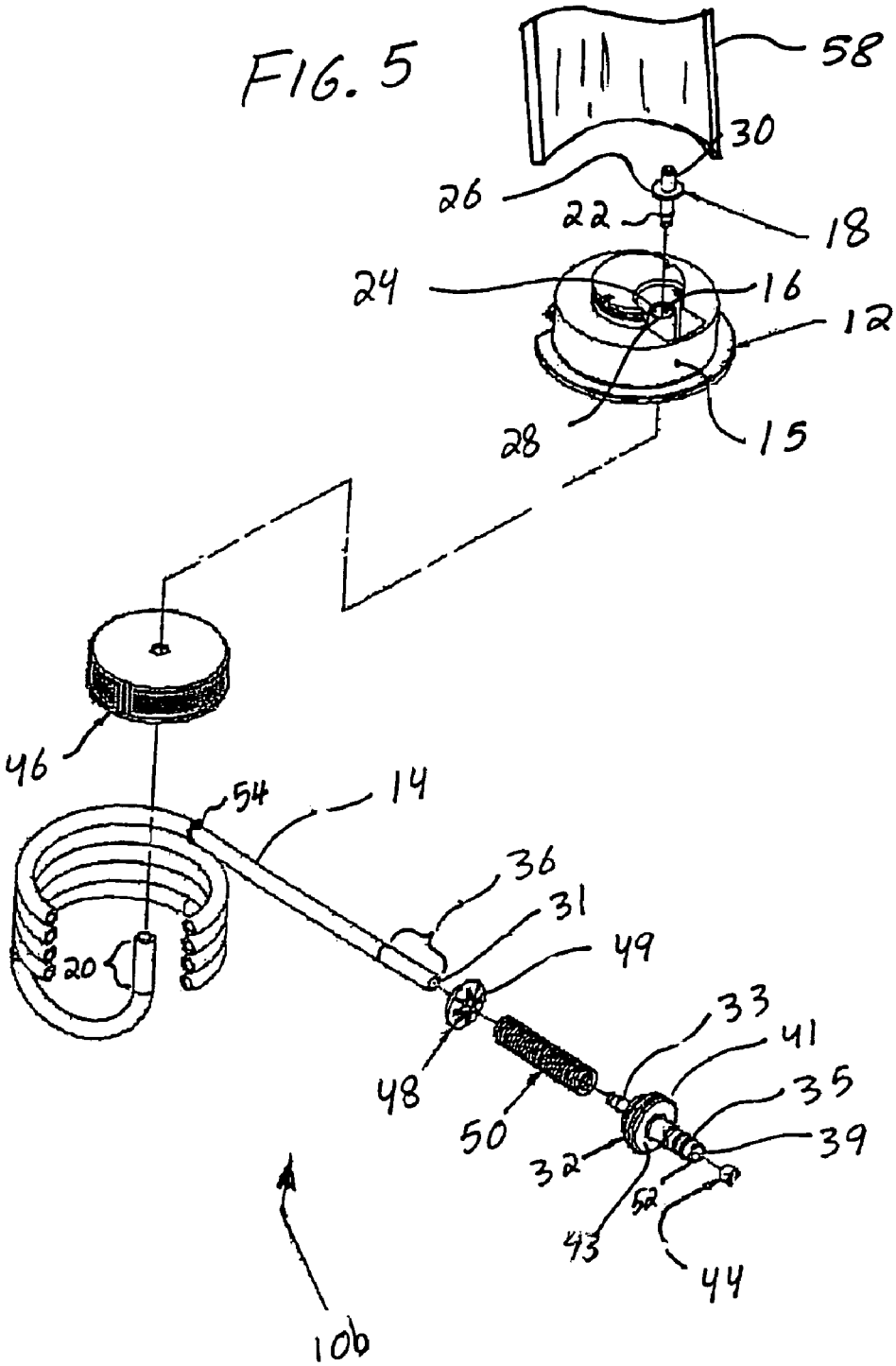
FIG. 5 is an exploded view of a second embodiment of the dispensing system according to the present invention, illustrating the remote retainer mounting location relative to the flexible delivery tube disclosed in its coiled storage/shipping configuration, and a closure cap for mounting the dispensing system to a container, and a cutout section of a power sprayer handle.
Figure 7:
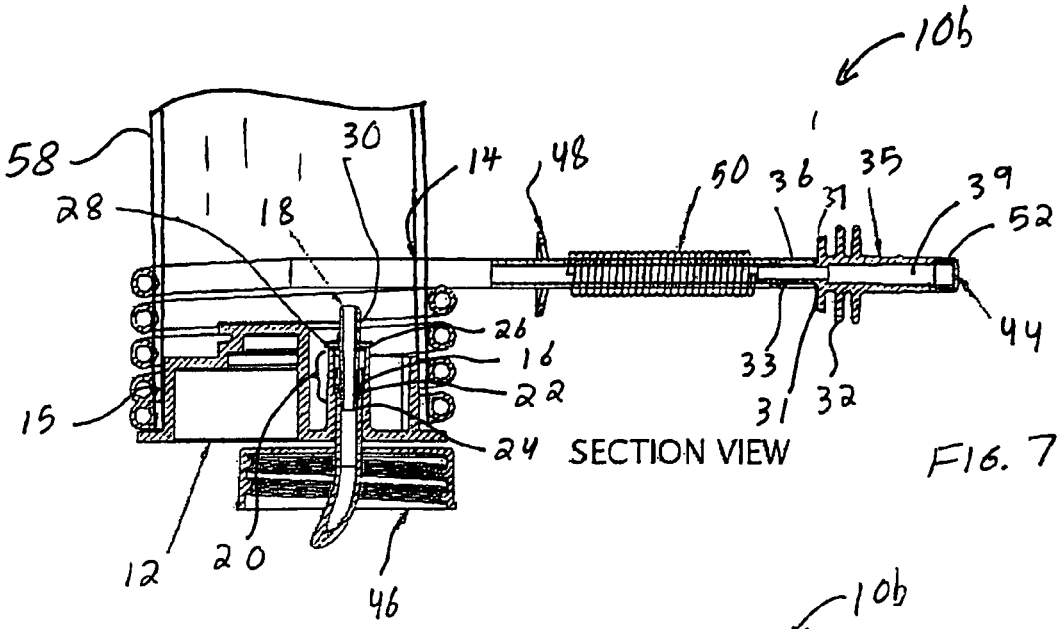
FIG. 7 is a cross-sectional view of the dispensing system of FIG. 5, taken generally along line B-B in FIG. 6, illustrating the internal features of the dispensing system, and a cutout section of a power sprayer handle.
Figure 6:
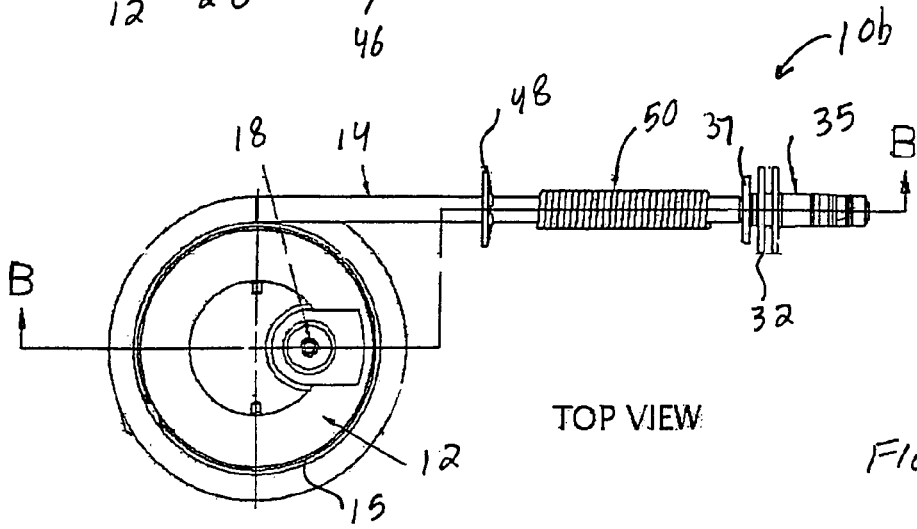
FIG. 6 is a top view of the second embodiment of the dispensing system of FIG. 5, illustrating the dispensing system in an assembled configuration and the flexible delivery tube disclosed in its coiled storage/shipping configuration.

As shown in FIGS. 5-8, as discussed above for the first embodiment, the second embodiment of dispensing system 10*b* may also generally include a trigger sprayer, such as a power sprayer 58 of known design removably mounted onto remote retainer 12 for spraying liquid product from a container therethrough. The second embodiment for dispensing system 10 may include flexible delivery tube 14 inserted into elongated opening 16 of remote retainer 12 and plugged onto one end of retainer adaptor 18 until it reaches retention ring 26 of retainer adaptor 18. As shown in FIGS. 5, 7 and 9, tube 14 may be sealingly retained within elongated opening 16 such that the internal wall of section 20 is sealingly disposed onto tube retention nipple 22 of adaptor 18, and the external wall of section 20 is sealingly compressed by internal wall 24 of elongated opening 16. In this manner, with section 20 of tube 14 clamped between elongated opening 16 and tube retention nipple 22 of adaptor 18, retainer adaptor 18 functions to relieve the connection strain between remote retainer 12 and tube 14 as power sprayer 58 is maneuvered during use, which tends to disconnect tube 14 from remote retainer 12. Tube retention nipples 22 and 33 of retainer adaptor 18 and connector hose 32, respectively, may each include circular ridges 56 which dig into tube 14 to prevent tube 14 from being removed therefrom.

In the second embodiment 10*b*, retention ring 26 of retainer adaptor 18 may be disposed in contiguous engagement with upper rim 28 of elongated opening 16 to prevent adaptor 18 from being inserted through opening 16. The opposite nipple 30 of adaptor 18 may include a product inlet tube (not shown) connected to a product housing (not shown) within power sprayer 58 for supplying product from tube 14 out through the power sprayer, as discussed in greater detail in previously incorporated co-owned U.S. Ser. No. 10/791,285.

Figure 8:
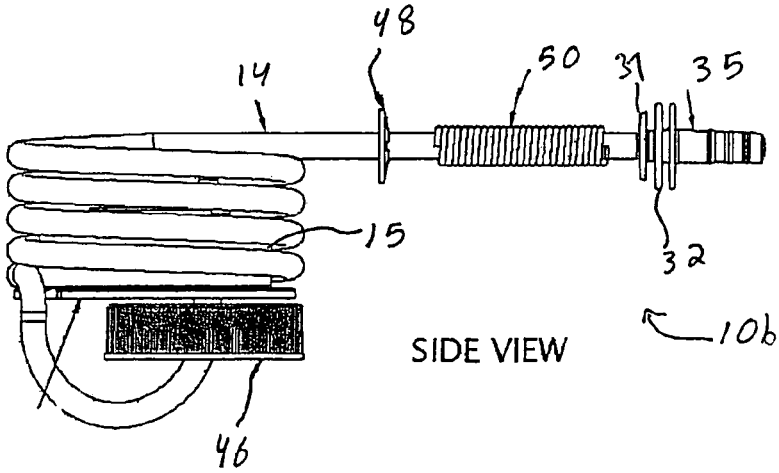
FIG. 8 is a side view of the dispensing system of FIG. 5, illustrating the dispensing system in an assembled configuration and the flexible delivery tube disclosed in its coiled storage/shipping configuration.

In addition to the aforementioned features, the second embodiment 10*b* of the dispensing system of the invention may include a closure cap 46 slidably disposed on tube 14 and retained at a predetermined distance from connector hose 32 by means of adaptor 48 as best seen in FIGS. 5, 7 and 8. Adaptor 48 may include a plurality of tines 49 for clamping onto tube 14 at a predetermined location and may be retained adjacent connector hose 32 by means of notch 54 (FIG. 5) on tube 14 which prevents adaptor 48 from being slid upwards towards remote retainer 12. In this manner, the distance of closure cap 46 from connector hose 32 may be adjusted by moving adaptor 48 as needed such that once cap 46 is mounted on a container, connector hose 32 rests adjacent the bottom surface of the container.

As shown in FIG. 5, the opposite or distal end 31 of tube 14 may be connected to connector hose 32 and include a spring weight 50 slidably disposed thereon for maintaining connector hose 32 adjacent the bottom surface of the container once the container is held upright regardless of how the container is tipped prior to being held upright. Compared to the first embodiment 10*a* of the dispensing system of the invention, the second embodiment 10*b* does not require the use of a connector adaptor 34, since connector hose 32 in the second embodiment is inserted freely into a container, as opposed to the first embodiment in which connector hose 32 is connected to a prefabricated hole within the closure of the container, as discussed in detail in U.S. Pat. No. 6,409,052. Moreover, for the second embodiment 10*b* of the dispensing system, in addition to connector hose 32 and spring weight 50, the hose assembly may include filter 44 mounted into receptacle 52 of hose 32. As also discussed for the first embodiment, for the second embodiment of the dispensing system, connector hose 32 may be of one-piece plastic construction having a cylindrical body with a tube retention nipple 33 and an opposite nipple 35 depending therefrom. The body of connector hose 32 may also include the radially extending rings 37, 41, 43 with ring 37 acting as a stop for spring weight 50 and rings 41 and 43 acting as a gripping surface. The axial nipples 33 and 35 contain a central passage 39 coaxial with each nipple. As shown in FIGS. 5 and 7, section 36 of tube 14 may be plugged onto tube retention nipple 33 of connector hose 32, and the complete hose assembly may be inserted freely into a container, as discussed above.

From the foregoing it can be seen that a simple and economical, yet highly effective dispensing system has been devised for a remote pump sprayer. In one embodiment, the flexible delivery tube includes one end thereof non-removably connected to a remote retainer and the other end thereof non-removably connected to a connector hose. The remote retainer and connector hose each include strain relief means which respectively include a retainer adaptor and a connector adaptor for relieving the connection strain between the tube, the remote retainer and connector hose, as the power sprayer is being pulled and maneuvered during use. In a second embodiment, the flexible delivery tube includes one end thereof non-removably connected to a remote retainer and the other end disposed freely in a container, but plugged onto a connector hose and including a spring weight slidably disposed thereon. The structure and arrangement of each connecting assembly is thus simplified for reducing the time and effort required for subassembly assembly thereby minimizing costs.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. An assembly for connecting a remote power sprayer to a container of liquid having a rigid dip tube, said assembly comprising:

a retainer adapted to be coupled to the remote power sprayer;

a connector hose;

a flexible hollow fluid delivery tube having a first end coupled to said retainer and a second distal end coupled to said connector hose, and said connector hose adapted to be coupled to the container of liquid; and first and second strain relief means for respectively relieving connection strain between said first end of said tube and said retainer, and said second distal end of said tube and said connector hose;

wherein said retainer includes a wall defining a first elongated opening therein, said first strain relief means includes a first tube retention device retained within said first elongated opening, and said first end of said delivery tube extends over said first tube retention device and is captured between said first tube retention device and said wall defining said first elongated opening.

2. An assembly according to claim 1, wherein:

said first tube retention device comprises a nipple having ridges which dig into said first end of said delivery tube.

3. An assembly according to claim 1, wherein:

said second strain relief means includes a second tube retention device.

4. An assembly according to claim 3, wherein:

said second tube retention device is integral with said connector hose.

5. An assembly according to claim 3, wherein:

said second strain relief means further includes a connector adaptor having a wall defining a second elongated opening, and said second end of said delivery tube extends over said second tube retention device and is captured between said second tube retention device and said wall defining said second elongated opening.

6. An assembly according to claim 5, wherein:

said second tube retention device comprises a nipple having ridges which dig into said second end of said delivery tube.

7. An assembly according to claim 5, wherein:

said connector hose includes at least one radially extending element which frictionally engages said connector adaptor.

8. An assembly for connecting a remote power sprayer to a container of liquid having a bottom surface, said assembly comprising:

a retainer adapted to be coupled to the remote power sprayer;

a connector hose;

a flexible hollow fluid delivery tube having a first end coupled to said retainer and a second distal end coupled to said connector hose, and said connector hose adapted to be coupled to the container of liquid;

a strain relief means for relieving connection strain between said retainer and said fluid delivery tube; and a weight provided adjacent said second distal end of said fluid delivery tube, said weight maintaining said connector hose adjacent the bottom surface of the container;

wherein said retainer includes a wall defining an elongated opening therein, said strain relief means includes a first tube retention device retained within said elongated opening, and said first end of said delivery tube extends over said first tube retention device and is captured between said first tube retention device and said wall defining said elongated opening.

9. An assembly according to claim 8, wherein:

said first tube retention device comprises a nipple having ridges which dig into said first end of said delivery tube.

10. An assembly according to claim 8, further comprising:

a closure cap slidably disposed on said delivery tube and adapted to mount on the container of liquid.

11. An assembly according to claim 10, further comprising:

an adaptor located between said closure cap and said connector hose, said adaptor having means for clamping onto said delivery tube.

12. An assembly according to claim 11, wherein:

said weight is located between said adaptor and said connector hose.

13. An assembly according to claim 11, wherein:

said delivery tube includes a notch, and said means for clamping are adapted to engage said notch.

14. An assembly according to claim 11, wherein:

said connector hose includes a second nipple having ridges which engage said second end of said delivery tube.

15. An assembly according to claim 9, wherein:

said connector hose includes a second nipple having ridges which engage said second end of said delivery tube.

16. An assembly according to claim 8, wherein:

said weight is a spring which is slidable on said delivery tube.

17. An assembly according to claim 8, further comprising:

a closure cap slidably disposed on said delivery tube and adapted to mount on the container of liquid; and an adaptor located between said closure cap and said connector hose, said adaptor having means for clamping onto said delivery tube.

* * * * *